United States Patent [19]

Nambu et al.

[11] Patent Number: 4,587,743

[45] Date of Patent: May 13, 1986

[54] METHOD OF CONTROLLING TEMPERATURE OF DRYING MACHINE

[75] Inventors: Yutaka Nambu; Hitosi Sugawara; Yasuo Saitoh, all of Hiratsuka, Japan

[73] Assignee: The Japan Tobacco & Salt Public Corporation, Japan

[21] Appl. No.: 662,079

[22] Filed: Oct. 18, 1984

[30] Foreign Application Priority Data

Oct. 20, 1983 [JP] Japan ..... 58-195335

[51] Int. Cl.[4] ..... F26B 21/10

[52] U.S. Cl. ..... 34/31; 34/48; 34/53

[58] Field of Search ..... 131/303; 34/46, 48, 34/119, 124, 39, 31, 53

[56] References Cited

U.S. PATENT DOCUMENTS 3,840,025 10/1974 Fowler et al. ..... 131/303

3,905,123 9/1975 Fowler et al. ..... 34/46

*Primary Examiner*—Larry I. Schwartz

*Attorney, Agent, or Firm*—Lowe, Price, LeBlanc, Becker & Shur

[57] ABSTRACT

A method of controlling the temperature of a drying machine by controlling the heat medium supply thereto in response to a signal representative of the temperature generated by a temperature detector for detecting the temperature of the drying machine comprising the steps of: supplying the heat medium to the drying machine for a period of time which is determined in accordance with an error signal between a reference signal corresponding to a preset target temperature range and said temperature signal and stopping the heat medium supply for a predetermined period of time after the lapse of the heat supplying period of time if said detected temperature does not reach at said predetermined target temperature range and change in temperature per unit time obtained from said temperature signal is equal to or lower than a predetermined value; stopping the heat medium supply if the detected signal does not reach at said target temperature range and said change in temperature per unit time is higher than said predetermined value; supplying the heat medium to the drying machine for the period of time determined in accordance with the error signal and stopping the heat medium supply for the predetermined period of time after lapse of the heat medium supply period if the detected temperature falls within said target temperature range and the change in temperature per unit time is equal to or lower than a predetermined minus value falls within said target temperature range and the change in temperature per unit is higher than said predetermined minus value; and stopping the heat medium supply if the detected temperature surpasses said target temperature range.

1 Claim, 5 Drawing Figures

METHOD OF CONTROLLING TEMPERATURE OF DRYING MACHINE

BACKGROUND OF THE INVENTION

The present invention relates to a method of controlling the temperature of a drying machine in response to a signal representative of the drying machine temperature generated by a temperature detector.

A preset initial temperature of a drying machine prior to initiating controlled temperature changes in the drying machine is desirable for adjusting the moisture ratio of tobacco leaves. In other words the machine should be controlled to adjust the moisture ratio of raw material to a target value soon after charging of raw material. The control requirements, however are complicated, resulting in difficulty in providing good control reproductivity.

SUMMARY OF THE INVENTION

It is, therefore, an object of the present invention to provide a method of controlling the temperature of a drying machine which is capable of presetting the initial temperature of the drying machine to an optimal value to control, in a simple manner, the drying process prior to initiating temperature control of raw material during drying.

The object of the present invention can be accomplished by providing a method of controlling the temperature of a drying machine by controlling the heat source supply thereto in response to a signal representative of the temperature generated by a temperature detector for detecting the ambient temperature within the drying machine. The method comprises the steps of: supplying the heat source to the drying machine for a period of time determined in accordance with an error signal between a reference signal corresponding to a preset target temperature range and a temperature signal indicative of ambient temperature and stopping the heat source supply for a predetermined period of time after the lapse of the heat source supplying period of time if the detected temperature does not reach the predetermined target temperature range and change in temperature per unit time obtained from the temperature signal is equal to or lower than a predetermined value; stopping the heat source supply if the detected signal does not reach at the target temperature range and the change in temperature per unit time is higher than the predetermined value; supplying heat from the heat source to the drying machine for the period of time determined in accordance with the error signal and stopping the heat source supply for the predetermined period of time after lapse of the heat source supply period if the detected temperature falls within the target temperature range and the change in temperature per unit time is equal to or lower than a predetermined minus value; stopping the heat source supply if the detected temperature falls within the target temperature range and the change in temperature per unit is higher than the predetermined minus value; and stopping the heat source supply if the detected temperature surpasses the target temperature range.

DESCRIPTION OF THE PREFERRED EMBODIMENT

Figure 1:
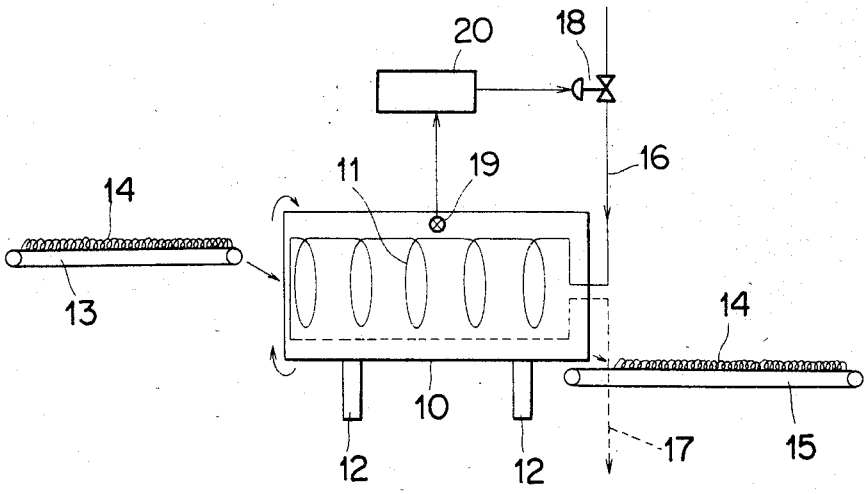
FIG. 1 is a schematic view showing a drying machine, the temperature of which is controlled in accordance with the present invention.

FIG. 1 is a schematic view of a drying machine, the temperature of which is controlled in accordance with the present invention. The drying machine comprises a cylindrical rotating drum 10 having therein a steam pipe 11 for supplying steam which serves as a heat source. The drum 10, which is slightly tilted, rotates by means of driving rollers 12. Tobacco leaves, i.e., raw material, is conveyed by a conveyer 13 and charged into one end of the drum. Discharge occurs from the other end opening onto a conveyor 15 after being dried. Steam pipe 11 is connected with a steam pipe 16 supplying steam serving as a heat source and a drain pipe 17 removes condensate from the system. A diaphragm valve 18 is interposed in the steam pipe 16 for starting or stopping the supply of steam. The drum is provided with a temperature detector 19 for detecting the temperature within the drum. The valve 18 is controlled to open or close in response to a control signal from a control device 20 responsive to the temperature signal from the temperature detector 19 so that the temperature inside the drum 10 is elevated to a preset target temperature and maintained at about that temperature.

Figure 2:
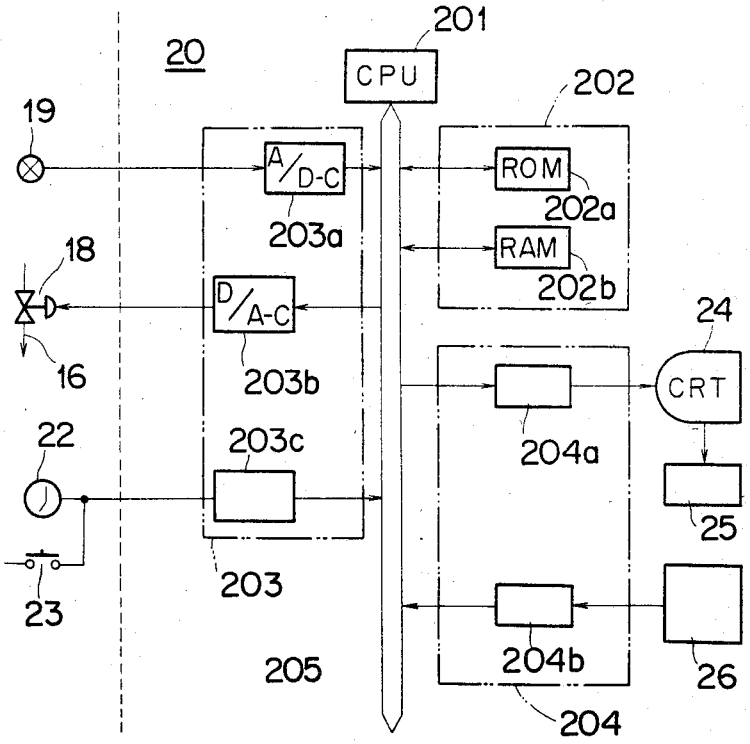
FIG. 2 is a block diagram showing a microcomputor forming the control device.

The control device 20 comprises an electronic computor such as microcomputor. The brief summary of the control device will be described with reference to FIG. 2. Reference 201 in FIG. 2 represents a control processor unit (hereinafter referred to as CPU) adapted to control the jobs which the computor executes in accordance with a program; to control arithmetic processing required during the execution of the job and to control other devices and to manage the reception of the date required for the control.

Reference 202 represents a memory comprising a read only memory (hereinafter referred to as ROM) **202*a* in which programs for predetermined jobs the computor executes are stored and a read/write memory (hereinafter referred to as RAM) 202*b*** in which constants required for the program, operation results and input data are stored.

Reference numeral 203 represents a process input/output device which comprises and analog/digital convertor **203*a* (hereinafter referred to as A/D-C) which converts the temperature signal from the temperature detector 19 into a digital signal suitable for computor processing; a digital/analog convertor 203*b* (hereinafter referred to as D/A-C) which converts the digital data obtained by arithmetic operation in the computor into analog output for driving diaphragm valve 18; and a digital input device 203*c* for inputting into a data bus 205 a digital signal for starting the preset apparatus in response to a signal generated at a given time by a timer console 22 or a signal generated at a desired time by a manual switch 23**.

Reference numeral 204 represents an input/output device which comprises a serial interface **204*a* for reception and feeding of data from and to the computor when video information or input data are displayed on CRT display 24 or printed out by a printer 15 and a keyboard input device 204***b* for transforming the data from a keyboard 26 operated by an operator when constants are changed, etc. and transmitting them to CPU 201.

Figure 3:
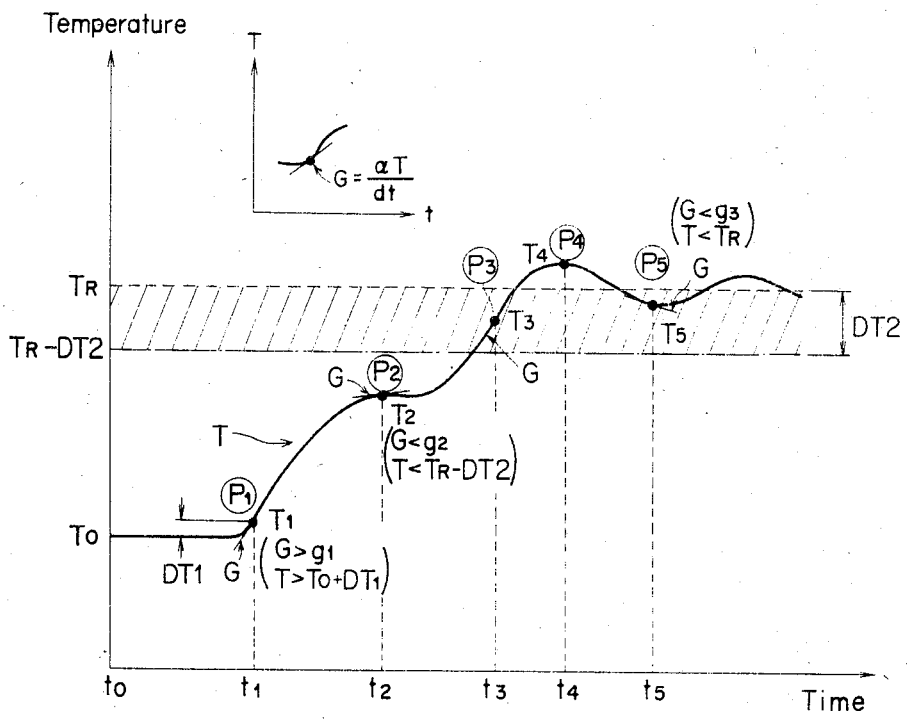
FIG. 3 is a chart showing a temperature control of the present invention.

The afore-mentioned control device 20 carries out the temperature control of the drying machine in accordance with a temperature chart shown in FIG. 3.

Figure 4:
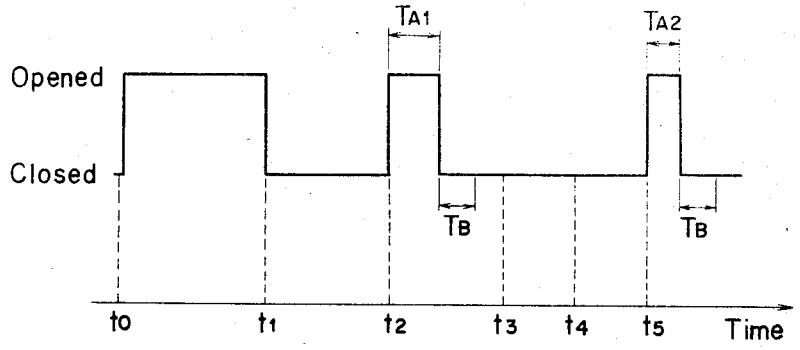
FIG. 4 is a timing chart explanation of the valve operation when temperature control is carried out as shown in FIG. 3.

When the temperature just before the start of the control is $T_0$, the diaphragm valve 18 is opened to supply steam to the steam pipe 11 at a time $t_0$ as shown in FIG. 4 in order to raise the temperature to $T_R$ preset as a target temperature. The steam supply causes the temperature within the drum 10 to rise. The elevation in temperature is detected by the temperature detector 19 and is then inputted into control device 20.

Upon the basis of the temperature signal from the temperature detector 19, the control device 20 determines whether the change in temperature per unit time $DT/dt=G$ is larger than a preset temperature gradient constant $g_1$, that is $$G>g_1 \quad (1)$$

or the temperature of the drum 10 is higher than a temperature $T_1$ including the temperature $T_0$ at the start of control plus a preset temperature coefficient $DT_1$, that is, $$T>T_0+DT_1=T_1 \quad (2).$$

The diaphragm is closed at the time of judgment $t_1$ if one of the afore-mentioned formulae (1) and (2) is satisfied. The position on the chart corresponding to the time $t_1$ is represented at $P_1$.

The temperature within the drum 10 continues to rise by residual steam heat even when the valve 18 is closed as mentioned above. The control device judges whether G is lower than a preset temperature gradient constant $g_2$, that is, $$G<g_2 \quad (3)$$

and the temperature of the rotor 10 is lower than a temperature $T_2$ which is a target temperature $T_2$ which is a target temperature $T_R$ minus temperature coefficient $DT_2$, that is, $$T<T_R-DT_2=T_2 \quad (4)$$

The diaphragm valve 18 opens at the time of judgment $t_2$ if both formulae (3) and (4) are satisfied. The position corresponding to the time $t_2$ on the chart is represented as $P_2$. The period of time $TA_1$ for steam supply carried out by opening the diaphragm 18 is calculated in accordance with the following formula (5)

$$TA_1=(T_R-T_2)\cdot\alpha+\beta \quad (5)$$

wherein $\alpha,\beta$ are operation parameters.

After the passage of the period of time $TA_1$ for steam supply, the valve 18 is closed for only the period of time $T_B$ which is preset by assuming as a writing time an interval time, since the steam supply for the period of time $TA_1$ to occurrence of temperature change. The valve 18 is, of course, closed when any one of the formulae (3) and (4) is satisfied even in the period of time $TA_1$.

The temperature is elevated by the residual heat of supplied steam. The valve 18 is held closed when the temperature $T_3$ of the drum 10 at the time $t_3$ (a point $P_3$ on the chart) falls in a range of the target temperature, that is, $$T_R-DT_2<T_3<T_R \quad (6)$$

and $$G>g_3 \quad (7)$$

wherein $g_3$ is a temperature gradient constant or when the time at the time $t_2$ (point $T_4$ on the chart) is higher than $T_R$, that is, $$T_4>T_R \quad (8)$$

At the time $t_5$ (point $P_5$ on the chart) from which the temperature begins to fall due to heat radiation from the drum with the lapse of time, the control device determines whether the temperature $T_5$ is lower than a target temperature $T_R$, that is, $$T_5<T_R \quad (9)$$

and $$G<g_3 \quad (10).$$

The valve 18 is opened for supplying steam when both of the formulae (9) and (10) are satisfied. The period of steam supply $TA_2$ is calculated in accordance with the formula (11).

$$TA_2=(T_R-T_5)\cdot\alpha+\beta \quad (11)$$

The valve 18 is closed only a waiting time $T_B$ after steam supply for a period of time $TA_2$. The valve is, however, closed immediately when any one of the formulae are not satisfied.

The temperature of the drying machine is maintained around the target temperature $T_R$ by continuing the aforementioned operation.

Figure 5:
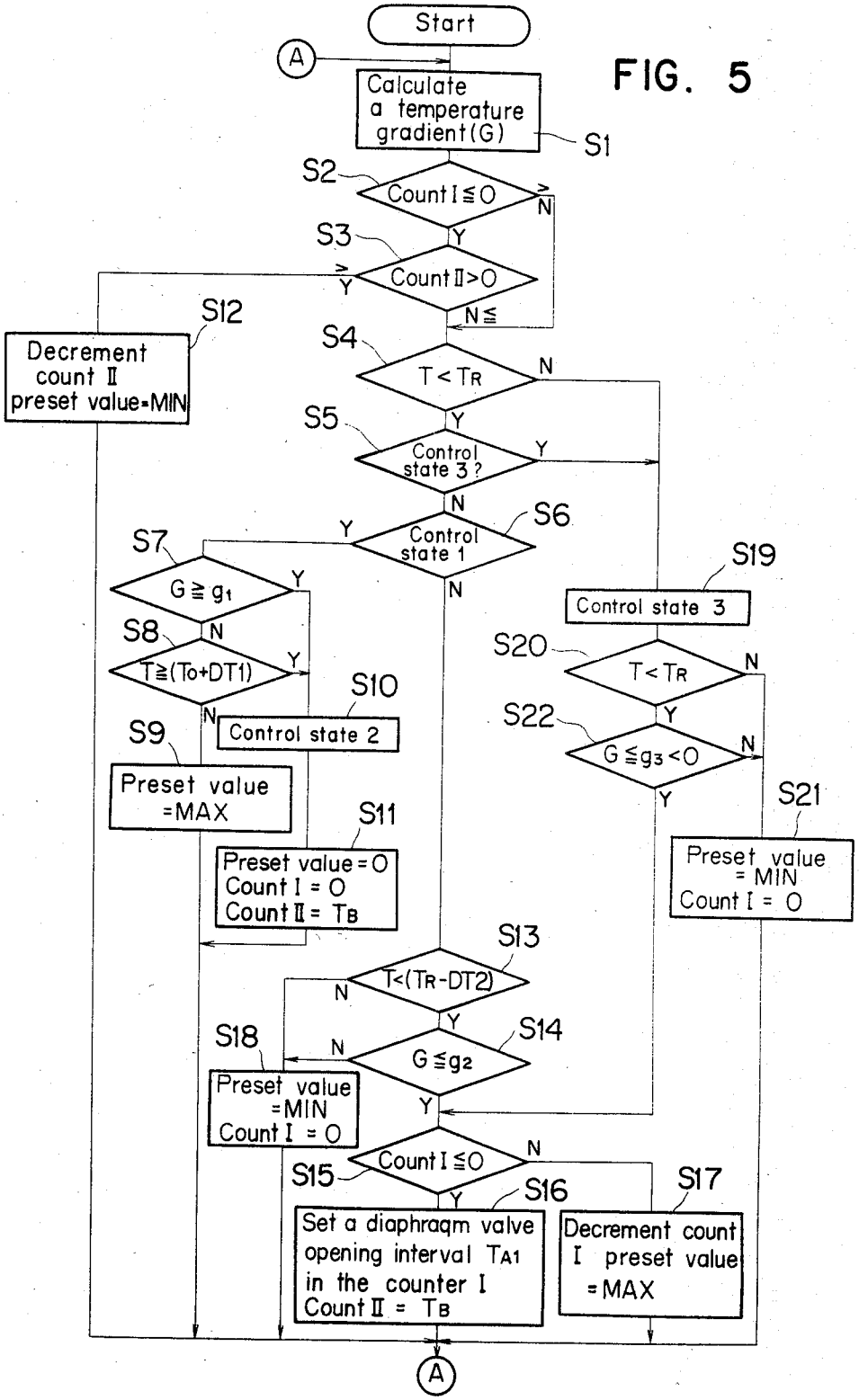
FIG. 5 is a flow chart showing a program for temperature control carried out by the control device shown in FIG. 4.

FIG. 5 is a flow chart of a program for executing the afore-mentioned control.

In the shown chart, when the program starts, the control device 20 calculates a temperature gradient, that is, change in temperature per unit time G in accordance with the temperature signal from the temperature detector 19 at step $S_1$. The control device then determines whether or not the content of a counter I for setting the opening interval of diaphragm valve 18 is equal to or larger than zero at step $S_2$. Since the content of the counter is now zero, the program proceeds to step 3 at which the control device determines whether or not the content of a counter II for setting the close interval of the diaphragm valve 18 is larger than zero. Since nothing is stored in the counter II, program proceeds to step 4 at which the control device determines whether or not the temperature T represented by the temperature signal from the temperature detector 19 is lower than the target temperature. Since temperature T is, of course, lower than $T_R$ at this time, program proceeds to step $S_5$. The control device determines whether or not control state is 3. The control state used herein means a state which is incremented from 1 to 3 depending on the progress in control. The control state is now 1 since the program has just started. Then the program proceeds to step 6 at which judgment is carried out whether or not the control state is 1. Since the answer is yes at this time, program proceeds to step 7.

At step 7 judgment is carried out whether or not the value G obtained at Step $S_1$ is equal to or larger than a preset temperature gradient constant $g_1$. If the result of judgment is no, program proceeds to step 8 at which the judgment is carried out whether or not the detected temperature is equal to or larger than the temperature $T_0$ at the start of control plus the preset temperature $DT_1$. Since the result of judgment is, of course, No, the program proceeds to next step $S_9$ at which the opening of the diaphragm valve 18 is set to the maximum to supply steam. After the steam begins to be supplied program returns to step $S_1$ again to detect G upon the basis of the detected temperature signal.

Program goes to step 4 via steps $S_2$ and $S_3$ since the counters I and II are not set at the afore-mentioned steps. If $T<T_R$ by the steam supply, program goes to step 5. Since the control state is still 1 at the afore-mentioned operation, program proceeds to step $S_7$ via step $S_6$.

Program goes to step $S_{10}$ to set the control state 2 when G is calculated at step $S_1$ is equal to or larger than $g_1$ or the temperature T is equal to or larger than $T_0+DT_1$ due to elevation in temperature by steam supply. At next step $S_{11}$ the opening of the diaphragm valve 18 is set to zero, that is, the valve is closed and zero is set in the counter I and time $T_B$ is set in counter II. Program returns to step $S_1$ after step $S_{11}$.

By setting of $T_B$ in the counter II at the step $S_{11}$ the judgment at step $S_3$ is YES. Program goes to step $S_{12}$ at which the counter II is decremented and the opening of the diaphragm valve 18 is set to a minimum value. The valve may be closed at the minimum value.

After completion of the step $S_{12}$, program returns to step $S_1$ and goes to step $S_6$ via steps $S_2$, $S_3$, $S_4$ and $S_5$. Program goes to step $S_{13}$ since judgment is No at step $S_6$. at step $S_{13}$, judgment whether or not the detected temperature is lower than the target temperature $T_R$ minus preset temperature $DT_2$ is carried out. If the judgment result is YES, the judgment whether or not G is equal to or larger than a preset value $g_2$ is carried out at next step 14. If the judgment result is YES, judgment whether or not the content of the counter I is equal to or lower than zero is carried out at step $S_{15}$. The judgment result is YES. The program thus proceeds to step 16 at which the opening period time $TA_1=(T_R-T)$ for the diaphragm valve 18 is set in the counter I and the time $T_B$ is set to the counter II. After execution of step $S_{16}$, program returns to step $S_1$ again and then returns to step $S_{15}$ via steps $S_2$, $S_4$, $S_5$, and $S_6$, $S_{13}$ and $S_{14}$. Since the judgment at step $S_{15}$ is No, program proceeds to step $S_{17}$ at which the document of the counter I is started and the opening of the diaphragm valve 18 is set to a maximum value.

After completion of the step $S_{17}$, program returns to step $S_1$ and loops through the steps $S_1$, $S_2$, $S_4$ to $S_6$, $S_{13}$ to $S_{15}$, $S_{17}$ until the content of the counter I becomes zero. When the content of the counter I becomes zero, judgment at step $S_2$ is YES and program does not go to step $S_4$, but step $S_3$. When judgment at step $S_3$ is YES, program proceeds to step $S_{12}$ at which decrement of the counter II begins and the opening of the valve 18 is set to a minimum, that is, closed. Program then returns to step $S_1$. The job of the loop including steps $S_1$ to $S_3$ and $S_{12}$ is executed.

If the judgment at step $S_{13}$ or $S_{14}$ is No in the course of the decrement of the counter I via steps $S_{17}$, program proceeds to step $S_{18}$ at which the opening of the diaphragm valve 18 is minimized, that is, closed and the counter I is cleared to set zero. After completion of step $S_{18}$, program returns to step $S_1$ and via steps $S_2$ and $S_3$ goes to step S 12 at which the decrement of the counter II begins and the valve opening is minimized, that is, closed. Operation via step $S_{12}$, is continued until the period of time $T_B$ stored in counter II has passed. After the lapse of $T_B$, operation is carried out via steps $S_2$ to $S_6$, $S_{13}$ or $S_{14}$, $S_{18}$ after the lapse of $T_B$. Judgment at step $S_4$ is No when the temperature T becomes higher than $T_R$ by residual heat of steam. As the result of this program goes to step $S_{19}$.

Control state is set to 3 at step $S_{19}$. Program then proceeds to step $S_{20}$ at which judgment whether or not T is lower than $T_R$ is carried out. If the result of judgment is No, program proceeds to step $S_{21}$ at which the opening of the diaphragm valve 18 is minimized, that is, closed and the counter I is set to zero. The content of the step $S_{21}$ is similar to that of step $S_{18}$. Following the step $S_{21}$, progam returns to step $S_1$ and goes to step $S_4$ via $S_2$ and $S_3$. If the judgment result is YES, program proceeds to step $S_5$. Since the judgment at step $S_5$ is YES, program proceeds to step $S_{20}$ via step $S_{19}$. Since the judgment at step $S_{20}$ is also YES, the program proceeds to step $S_{22}$ at which judgment whether or not G is equal to or lower than a preset minus temperature gradient constant $g_3$. If the judgment result is No, program proceeds to step $S_{21}$. If YES, it proceeds to step $S_{15}$.

When program proceeds to step $S_{15}$, judgment whether or not the content of the counter I is equal to or lower than zero is carried out at this step $S_{15}$. Since the judgment result is YES, program proceeds to step $S_{16}$ at which the valve opening interval $TA_1$ of the diaphragm valve 18 and valve closing interval $T_B$ are stored in counters I and II respectively. Then program returns to step $S_1$ and goes to step $S_{17}$ via steps $S_2$, $S_4$, $S_5$, $S_{19}$, $S_{20}$, $S_{22}$ and $S_{15}$. At step $S_{17}$ the decrement of the counter I is started and the diaphragm valve 18 is fully opened. Following the step $S_{17}$, program returns to step $S_1$. Control is then carried out via one of steps $S_{12}$, $S_{16}$, $S_{17}$ and $S_{21}$ to close or open the valve such that the temperature T is maintained around the target temperature $T_R$.

In accordance with the present invention, the temperature of the drying machine can be maintained to approximate the target temperature in a simple manner. Presetting of an initial temperature required for controlling the moisture rate on charging of raw material such as tobacco leaves can readily be realized. Practically very useful effects can be provided.

What is claimed is:

1. A method of controlling by presetting the initial ambient temperature within a drying machine by controlling a supply of heat thereto from a heat source in response to a temperature signal representative of the ambient temperature generated by a temperature detector for detecting the ambient temperature within the drying machine, comprising the steps of:

(a) supplying heat from the heat source to the drying machine for a period of time determined in accordance with an error signal between a reference signal corresponding to a preset target temperature range and said temperature signal when said detected temperature is outside said preset target temperature range and a change in temperature per unit time obtained from said temperature signal is about equal to or lower than a predetermined value and stopping the heat source supply for a predetermined period of time following termination of the heat source supplying period of time;

(b) stopping the heat source supply if the detected signal is outside said preset target temperature range and said change in temperature per unit time is higher than said predetermined value;

(c) supplying heat from the heat source to the drying machine for the period of time determined in accordance with the error signal if the detected temperature falls within said target temperature range and the change in temperature per unit time is equal to or lower than a predetermined minus value and stopping the heat source supply for the predetermined period of time following termination of the heat source supply period;

(d) stopping the heat source supply if the detected temperature falls within said target temperature range and the change in temperature per unit time is higher than said predetermined minus value; and (e) stopping the heat source supply if the detected temperature surpasses said target temperature range.

* * * * *

UNITED STATES PATENT AND TRADEMARK OFFICE

CERTIFICATE OF CORRECTION

PATENT NO. : 4,587,743

DATED : May 13, 1986

INVENTOR(S) : Yutaka NAMBU et al

It is certified that error appears in the above-identified patent and that said Letters Patent is hereby corrected as shown below:

On the Title Page, Item /73/ should read:

[73] Assignee: Japan Tobacco, Inc., Japan

Signed and Sealed this

Twenty-fourth Day of March, 1987

*Attest:*

DONALD J. QUIGG

*Attesting Officer*

*Commissioner of Patents and Trademarks*